US011547164B2

(12) United States Patent
Baker et al.

(10) Patent No.: US 11,547,164 B2
(45) Date of Patent: Jan. 10, 2023

(54) MATERIAL PRODUCT HOLDING SYSTEMS AND METHODS

(71) Applicant: SoftWear Automation, Inc., Cumming, GA (US)

(72) Inventors: Michael J. Baker, Acworth, GA (US); Dylan Hutcheson, Atlanta, GA (US); Andrew Jackson, Atlanta, GA (US); Luther Lloyd, III, Dallas, GA (US); Stephen Ruderman, Marietta, GA (US); Wael Saab, Atlanta, GA (US)

(73) Assignee: SOFTWEAR AUTOMATION, INC., Cumming, GA (US)

( * ) Notice: Subject to any disclaimer, the term of this patent is extended or adjusted under 35 U.S.C. 154(b) by 0 days.

(21) Appl. No.: 17/329,537

(22) Filed: May 25, 2021

(65) Prior Publication Data

US 2022/0378135 A1 Dec. 1, 2022

(51) Int. Cl.
*A41H 43/02* (2006.01)
*A41H 42/00* (2006.01)

(52) U.S. Cl.
CPC ..... *A41H 43/0242* (2013.01); *A41H 42/00* (2013.01)

(58) Field of Classification Search
CPC ..... A41H 42/00; D05B 13/00; D05B 21/007; D05B 23/006–009; D05B 33/00; D05B 39/00
See application file for complete search history.

(56) References Cited

U.S. PATENT DOCUMENTS 5,419,268 A * 5/1995 Fyler ..... D05B 23/00 112/470.14
5,638,998 A * 6/1997 Thompson ..... A41H 33/00 112/470.14
5,642,680 A * 7/1997 Thompson ..... D05B 33/00 112/470.14

(Continued)

FOREIGN PATENT DOCUMENTS

EP 1147890 A1 10/2001

OTHER PUBLICATIONS

International Search Report for PCT/US2022/072552 dated Sep. 16, 2022.

*Primary Examiner* — Nathan E Durham
(74) *Attorney, Agent, or Firm* — Thomas | Horstemeyer, LLP

(57) ABSTRACT

Various examples are provided related to processing and handling of products. In one example, among others, a material product holding system includes a product holding assembly and a structure supporting the product holding assembly, the structure coupled to the positioning assembly. The product holding assembly can include support arms and a positioning assembly that can adjust positioning of the support arms with respect to each other to engage with at least a portion of a product supported by the support arms. In another example, a method include engaging support arms with a surface of at least a portion of a product, the support arms tensioning the product, positioning the support arms to load the product on a workstation, contracting the support arms to remove the tension, processing the product, re-engaging the support arms after completion of the processing, and unloading the product from the workstation.

20 Claims, 4 Drawing Sheets

(56) References Cited

U.S. PATENT DOCUMENTS

| | | | | |
|---|---|---|---|---|
| 6,158,367 | A * | 12/2000 | Jordan | D05B 23/007<br>112/470.08 |
| 6,439,370 | B1 | 8/2002 | Hoffman et al. | |
| 10,895,030 | B1 | 1/2021 | Baker et al. | |

* cited by examiner

MATERIAL PRODUCT HOLDING SYSTEMS AND METHODS

BACKGROUND

In the production of garments or other products, loading and unloading the garments or other material products precisely on and off processing equipment for sewing, printing or other production operations is a critical, time consuming, and repetitive process that may pose dangers to a human operator due to exposure to moving machinery. For example, it is required to maintain precise positioning, orientation, and alignment of a garment relative to the processing equipment during loading for a sewing or embellishment operation as these factors can directly influence the quality output of the operation. Therefore, it is desirable for an automated solution to address these concerns.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

BRIEF DESCRIPTION OF THE DRAWINGS

The accompanying drawings illustrate various examples of systems, methods, and embodiments of various other aspects of the disclosure. Any person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles. Moreover, in the drawings, like reference numerals designate corresponding parts throughout the several views.

DETAILED DESCRIPTION

Figure 1:
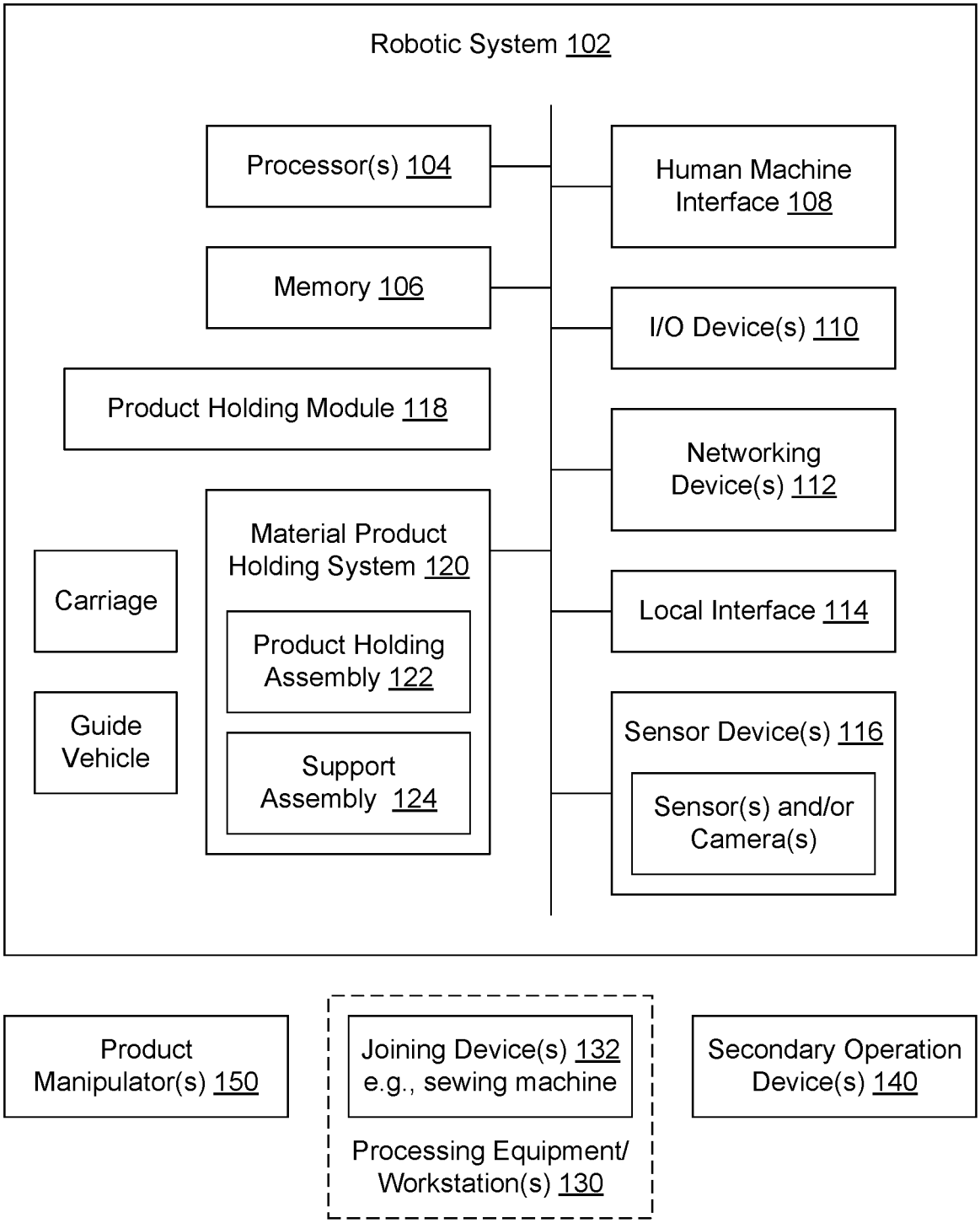
FIG. 1 illustrates an example of a material product holding system, according to various embodiments of the present disclosure.

Disclosed herein are various examples related to automation of sewing or bonding using robots. Reference will now be made in detail to the description of the embodiments as illustrated in the drawings. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred, systems, and methods are now described.

Embodiments of the present disclosure will be described hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Referring to FIG. 1, shown is an example of a system that can be used for holding and/or transporting, e.g., garments or other products for loading and unloading for sewing, bonding, printing, etc. While this disclosure presents the assemblies, systems and methods in the context of garments, the disclosure is equally applicable to other types of manufactured products. Products can include garments or other items manufactured from material. These products can include, but are not limited to, pillowcases, covers, bags, etc. In the context of this disclosure, a garment refers to garments or portions of garments being processed by the system to produce a finished product. For example, the system can be used to load a garment or portion of a garment onto processing equipment or workstation for processing during the production process or unloading the garment or portion of the garment after the processing by the equipment or workstation is complete or stopped. The system can also be used to transport the garment or portion of the garment between different pieces of processing equipment or workstations, conveying system and/or storage systems.

As illustrated in the example of FIG. 1, the system can comprise a robotic system 102, which can include a processor 104, memory 106, an interface such as, e.g., a human machine interface (HMI) 108, I/O device(s) 110, networking device(s) 112, and a local interface 114, and sensing device(s) 116. The sensing device(s) 116 can comprise a sensor or camera such as, e.g., an RGB camera, an RGB-D camera, a near infrared (NIR) camera, stereoscopic camera, photometric stereo camera (single camera with multiple illumination options), etc. Additionally, the robotic system 102 can include a material product holding system 120, which may be utilized in the processing of the garments or other products. The product holding system 120 can include a product holding assembly 122 configured to hold the product or garment and a support assembly 124 configured to support and position the product holding assembly 122.

The robotic system 102 can transport, position and/or manipulate, e.g., a garment or portion of a garment with respect to processing equipment or a workstation 130 such as, e.g., the joining device 132. A workstation 130 performs an operation on a product or garment. Examples of processing equipment and workstations 130 include, but are not limited to, joining devices 132, side and shoulder seamers, collar attach systems, shoulder tape systems, sleeve attach systems, bottom hem systems, direct to garment printers, screen printers, etc. The material product holding system 120 can receive, e.g., a garment and position it for loading on a piece of equipment or workstation 130 for processing. Positioning of the garment can be automated and controlled by a product holding module 122. When the processing (e.g., joining, sewing, bonding, printing, etc.) is complete, the processed garment can be removed from the piece of processing equipment or workstation 130 by the same or a different material product holding system 120. The material product holding system 120 can also transport a garment or product to/from a storage system that can automatically stow or retrieve the garment or product, or to/from another conveyance system configured for transport of the garment or product. The storage or conveyance systems can include secondary operation device(s) 140 such as, e.g., stacking or de-stacking device(s), folding or unfolding device(s), and/or other product manipulation device(s) that can facilitate storage, retrieval or transport of the garment or product. The garment can be manually loaded on and/or removed from the material product holding system 120. In more fully automated processes, product manipulator(s) 150 can be used to autonomously install and/or remove the garment on the material product holding system 120. With the garment secured by the product holding assembly 122, the material product holding system 120 can transport the garment between processing operations at processing equipment or workstations 130 or storage by secondary operation devices 140 such as, e.g., hanging, folding, and/or stacking equipment. The material product holding system 120 can also provide the garment to a secondary operation device such as, e.g., a conveyance system for transport.

The processor 104 can be configured to decode and execute any instructions received from one or more other electronic devices or servers. The processor can include one or more general-purpose processors (e.g., INTEL® or Advanced Micro Devices® (AMD) microprocessors) and/or one or more special purpose processors (e.g., digital signal processors or Xilinx® System on Chip (SOC) field programmable gate array (FPGA) processor). The processor 104 may be configured to execute one or more computer-readable program instructions, such as program instructions to carry out any of the functions described in this description.

The memory 106 can include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions. The memory 106 can comprise modules that can be implemented as a program executable by processor(s) 104.

The interface(s) or HMI 108 can either accept inputs from users or provide outputs to the users or may perform both the actions. In one case, a user can interact with the interfaces using one or more user-interactive objects and devices. The user-interactive objects and devices may comprise user input buttons, switches, knobs, levers, keys, trackballs, touchpads, cameras, microphones, motion sensors, heat sensors, inertial sensors, touch sensors, or a combination of the above. Further, the interfaces can either be implemented as a command line interface (CLI), a graphical user interface (GUI), a human machine interface (HMI), a voice interface, or a web-based user-interface.

The input/output devices or I/O devices 110 of the robotic system 102 can comprise components used to facilitate connections of the processor 104 to other devices such as, e.g., product manipulator(s) 150, processing equipment or workstation(s) 130 such as, e.g., a joining device 132, secondary operation device(s) 140, sensing device(s) 116, material product holding system 120, or other equipment and can, for instance, comprise one or more serial, parallel, small system interface (SCSI), universal serial bus (USB), IEEE 1394 (i.e., Firewire™), or other appropriate connection elements.

The networking device(s) 112 of the robotic system 102 can comprise the various components used to transmit and/or receive data over a network. The networking device(s) 112 can include a device that can communicate both inputs and outputs, for instance, a modulator/demodulator (i.e. modem), a radio frequency (RF) or infrared (IR) transceiver, a telephonic interface, a bridge, a router, as well as a network card, etc.

The local interface 114 of the robotic system 102 can be, for example, but not limited to, one or more buses or other wired or wireless connections, as is known in the art. The local interface 114 can have additional elements, which are omitted for simplicity, such as controllers, buffers (caches), drivers, repeaters, and receivers, to enable communications. Further, the local interface 114 can include address, control, and/or data connections to enable appropriate communications among the components.

The sensing device(s) 116 of the robotic system 102 can facilitate detecting the movement and position of the material(s) and/or inspecting the material(s) for defects and/or discrepancies during a handling and/or processing operation. A sensing device 116 can comprise sensor(s) and/or camera(s) such as, but is not limited to, an RGB-D camera, near IR camera, time of flight camera, Internet protocol (IP) camera, light-field camera, monorail camera, multiplane camera, rapatronic camera, stereo camera, still camera, thermal imaging camera, acoustic camera, rangefinder camera, etc.

The product holding module 118, when executed by the processor 104, can control the robotic system to implement handling, transport and/or positioning of a garment or portion of a garment. The material product holding system 120 can manipulate the garment (e.g., a shirt) for loading onto processing equipment or workstation 130, unloading the processed garment from the processing equipment or workstation 130, and/or transport the garment between processing equipment or workstations 130 (e.g., joining device 132, etc.).

During operation, the material product holding system 120 can interact with one or more processing equipment or workstation(s) 130 and/or with secondary operation device(s) 140, in addition to product manipulator(s) 150. The material product holding system 120 can transport, position and/or manipulate, e.g., a garment or portion of a garment with respect to processing equipment or a workstation 130 or other secondary operation device 140. The processing equipment or workstation(s) 130 can comprise, e.g., joining devices 132, side and shoulder seamers, collar attach systems, shoulder tape systems, sleeve attach systems, bottom hem systems, printers, etc. The secondary operation device(s) 140 can include, e.g., stacking device(s), folding device(s), label manipulation device(s), and/or other storage or conveying device(s) that assist with the preparation, installation, removal and/or finishing of the product or garment.

For example, a workstation 130 can comprise a joining device 132 to facilitate joining (e.g., sewing or bonding) the portions of a product or garment. The joining device 132 can include, e.g., a sewing machine or a bonding apparatus (e.g., ultrasonic welding, thermal bonding, gluing or other bonding or joining technology). The joining device 132 can be configured to sew or otherwise bond or join (e.g., ultrasonic welding) material together along a path. The joining device 132 can sufficiently combine portions of a product or garment such that they remain connected through the intended life of the product or garment. A feed assembly of the joining device 132 can be used to control the feed of material through the joining device 132. For example, a feed dog of a sewing machine, a welding mechanism of an ultrasonic welder, belts, rollers or other feeding methods can be used. In addition, the joining device 132 can include a knife device (e.g., a tail knife or chain cutter) or other separation device in order to cut or sever the joining medium such as, e.g., threads, stitches, materials from the processed garment, etc.

The product manipulator(s) 150 can facilitate positioning or loading material(s) in preparation for and/or unloading after the processing operations by the processing equipment or workstations 130. For example, the garment or portion of a garment can be positioned or installed on the material product holding system 120 using a product manipulator 150 such as one or more end effector on, e.g., an industrial robot or other actuator (e.g., pneumatic or servo actuators) or appropriate manipulation assembly. Industrial robots include, e.g., articulated robots, selective compliance assembly robots (SCARA), delta robots, and cartesian coordinate robots (e.g., gantry robots or x-y-z robots). Industrial robots can be programmed to carry out repetitive actions with a high degree of accuracy or can exhibit more flexibility by utilizing, e.g., machine vision and machine learning. The processed garment can also be removed from the material product holding system 120 using end effectors on an industrial robot or other manipulator or appropriate manipulation assembly.

Functioning of a material product holding system 120 will now be discussed with reference to the example of FIGS. 2A and 2B. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 2A:
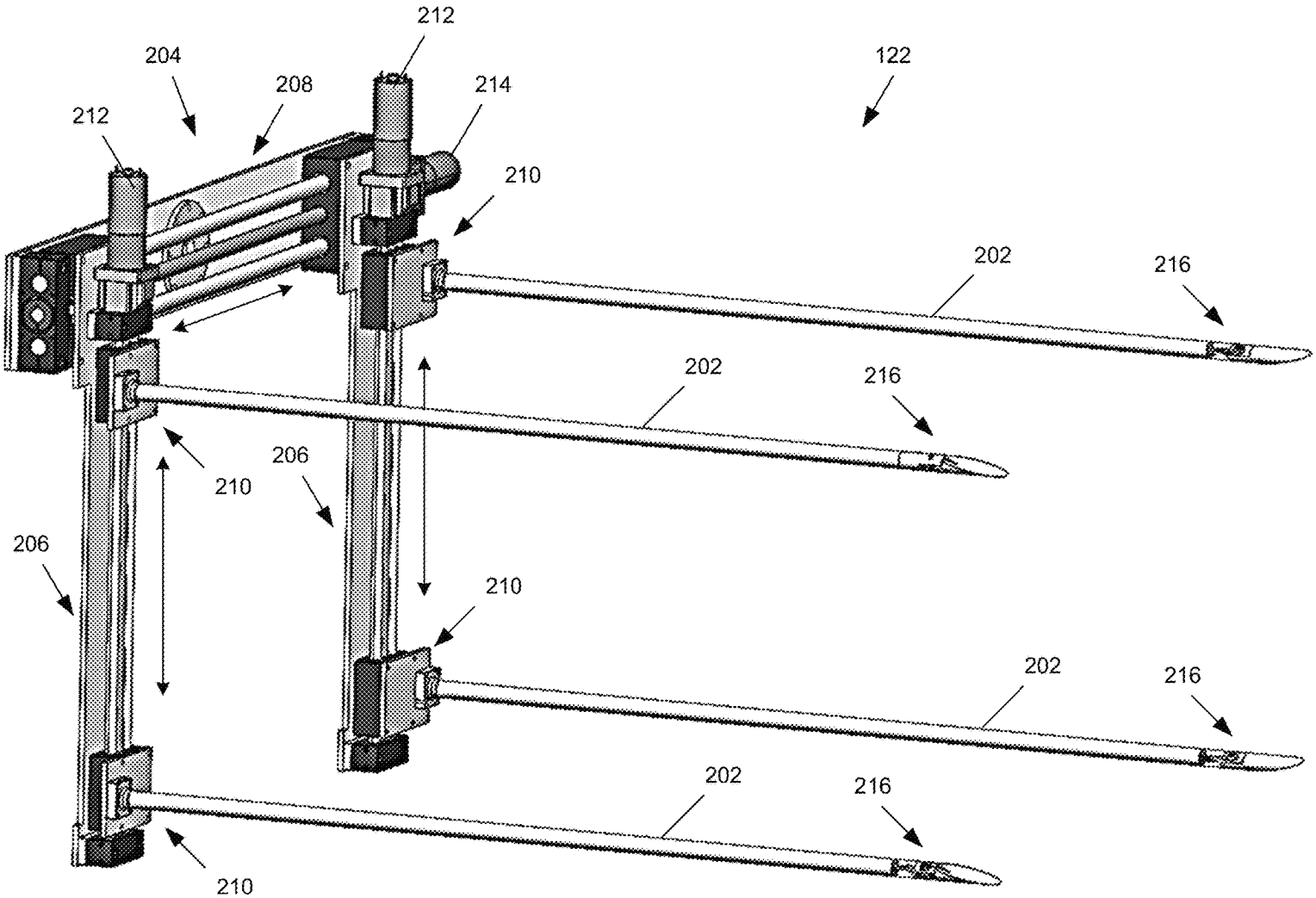
FIGS. 2A and 2B illustrate an example of a product holding assembly of the material product holding system, according to various embodiments of the present disclosure.

FIG. 2A illustrates an example of a product holding assembly 122 of the material product holding system 120, which can be coupled to a support assembly 124. The material product holding system 120 can facilitate loading and/or unloading of a garment or portion of a garment from a workstation or processing equipment 130 and can be used for transport of the garment or portion of the garment between workstations and/or processing equipment 130. The product holding assembly 122 comprises a plurality of support arms or rods 202 configured to hold a garment (e.g., a shirt or portion of thereof) or other product in position for loading, unloading, and/or transport of the garment. In the example of FIG. 2A, four substantially parallel support arms or rods 202 are shown, but other combinations and/or orientations of support arms or rods can be used. The support arms or rods 202 can be hollow or solid rods having a circular or geometric cross-section (e.g., triangular, rectangular or square, hexagonal, octagonal, etc.), flat, curved, contoured or angled plates, or other appropriate support or support configuration.

In various embodiments, support arms or rods 202 can be supported by a positioning assembly 204, which is configured to control the positioning of the support arms or rods 202 along, e.g., orthogonal translational axes. The support arms or rods 202 supporting the garment can be repositioned by the positioning assembly 204 to align with the workstation or processing equipment 130 to facilitate loading of the garment for processing or unloading after processing. For example, the spacing, width or radius of the plurality of support arms or rods 202 can be adjusted (either individually or in combination) to adjust the aspect ratio (length vs. width) of the product holding assembly 122. The support arms or rods 202 may also be configured to allow for their length to be adjusted or controlled (either individually or in combination), which would also affect the aspect ratio.

In some implementations, the support arms or rods 202 can be designed to adjust its curvature (e.g., an articulated or segmented along its length) or can include one or more mechanisms located along the length of the support arm or rod 202 that can expand or retract to change its contours. For example, one or more bladder incorporated in the support arm or rod 202 can be inflated or deflated to increase or decrease the diameter to control the contact area. Other mechanisms such as, e.g., wings or partial sleeves that fold against the support arm or rod 202 can be pivoted outward away from the support arm or rod 202 to increase the engagement with the garment or product and pivoted back to reduce the contact and profile of the support rod or arm 202. The support arms or rods 202 can also include one or more sensors at the same or different locations to monitor the positioning of the support arm or rod 202 with respect to the garment or product and/or the processing equipment or workstation 130 or secondary operation device 140. The sensor(s) can be used to align the support arms or rods 202 with the workstation 130 for loading or unloading of the garment or to detect the garment on either the support arms or rods 202 or the workstation 130.

In some embodiments, the configuration and geometry of the support arms or rods 202 can be controlled or adjusted for engagement and shaping of the supported garment or product. The length of the support arms or rods 202 can be controlled using a variety of methods. In some embodiments, the support arms or rods 202 can be extended using pneumatic or electrical drive mechanisms such as, e.g., drive screws or cables that can be driven using electrical or pneumatic actuators or plastic sheathing that can be inflated to extend the support arm or rod 202. Such arrangements can control or limit the amount of force being applied to the garment or product as the support arm or rod 202 is being extended. Shape and contours of the support arms or rods 202 can also be changed or adjusted or controlled. The support arm or rod 202 can also include orifices along its length to provide suction with a vacuum to improve the grip of the support arm or rod 202 on the supported garment or product.

The product holding assembly 122 can comprise a plurality of support arms 202 (e.g., two, three, four, or more) that extend outward from (e.g., substantially perpendicular to) the positioning assembly 204. The positioning assembly 204 can comprise pneumatically or electrically driven actuators 212/214 configured to adjust positions of the support arms or rods 202 for alignment of the supported product or garment with a workstation or processing equipment 130. For example, the support arms or rods 202 can be symmetrically distributed about the positioning assembly 204 (e.g., two support arms or rods about 180 degrees apart, three support arms or rods about 120 degrees apart, four support arms or rods about 90 degrees apart, etc.) or can be asymmetrically distributed. The number and arrangement of the support arms or rods 202 can be designed for a specific product or garment and one or more workstation or processing equipment 130. Actuators 212/214 can comprise, e.g., pneumatic or electric motors (e.g., stepper, permanent magnet, etc.), pistons, or other controlled actuation devices.

In the example of FIG. 2A, the positioning assembly 204 is an open-sided structure (e.g., a U-shaped structure) that can expand and contract along two orthogonal translational axes. The positioning assembly 204 can comprise first and second arm drive apparatus 206 aligned in a first direction and a cross-drive apparatus 208 attached to the pair of arm drive apparatus 206 in a direction orthogonal to the pair of arm drive apparatus 206. A support arm or rod 202 can be coupled to the arm drive apparatus 206 in a fixed or movable position. As shown in FIG. 2A, the support arms or rods 202 can be coupled to the pair of arm drive apparatus 206 by mounting blocks 210 coupled to guide rods mounted on a support plate. The pneumatically or electrically driven actuators 212 can turn a drive screw extending through the mounting blocks 210 to move the support arms or rods 202 in opposite directions on the guide rods. In some embodiments, positioning of the support arms or rods 202 can be independently controlled (e.g., using separate actuators). In other implementations, a first support arm or rod 202 can be mounted in a fixed location on the arm drive apparatus 206 (e.g., at one end of the arm drive apparatus 206) and a second support arm or rod 202 can be movably coupled to the arm drive apparatus 206 (e.g., by guide rods). For example, the top or bottom support arm or rod 202 can be fixedly attached to the support plate while the position of the other support arm or rod 202 (bottom or top) can be adjusted. The support arms or rods 202 can be coupled to the arm drive apparatus 202 at a proximal end or can be affixed at another location on the support arm or rod 202. In some embodiments, a support arm or rod 202 can extend through the support plate. For instance, a pneumatic or electric actuator can be used to control the length of the support arm or rod 202 extending outward from the support plate.

Each arm drive apparatus 206 can be coupled to the cross-drive apparatus 208 attaching the support plate to mounting blocks, which are coupled to guide rods. A pneumatically or electrically driven motor 214 can turn a drive screw extending through the mounting blocks to move the arm drive apparatus 206 in opposite directions on the guide rods. In this way, the support arms or rods 202 can be repositioned individually or in a coordinated fashion along two orthogonal translational axes. In some embodiments, positioning of the arm drive apparatus 202 can be independently controlled (e.g., using separate actuators). In other implementations, one of the arm drive apparatus 206 can be mounted to the cross-drive apparatus 208 in a fixed location (e.g., at one end of the cross-drive apparatus 208) while the position of the other arm drive apparatus 206 can be adjusted along the cross-drive apparatus 208 (e.g., left or right along guide rods). The support assembly 124 can be coupled to the cross-drive apparatus 208 and configured to adjust the position of the product holding assembly 122. For example, the support assembly 124 can adjust the position of the cross-drive apparatus 208 while the support arms or rods 202 are simultaneously adjusted on the arm drive apparatus 206 and/or the arm drive apparatus 206 are simultaneously adjusted on the cross-drive apparatus 208. In this way, it is possible for the support arms or rods 202 to be maintained about center point or location between the support arms or rods 202. This can allow for uniform expansion or contraction of the support arms or rods 202 about the center point or location while actuating or driving only a portion of the support arms or rods 202, which can simplify the control scheme. For example, the bottom support arms or rods 202 can be moved upward along the arm drive apparatus 206 towards the top support arms or rods 202 held in a fixed location. The support assembly 124 can simultaneously lower the product holding assembly 122 to maintain the support arms or rods equally spaced about a center point or plane.

Other arrangements of the positioning assembly 204 can also be utilized. For example, screw-driven scissor mechanisms can be used to support and reposition the support arms or rods 202. The product holding assembly 122 can also be configured to control the support arms or rods 202 using non-Cartesian movement. For example, the support arms or rods 202 can be repositioned radially about a center point or otherwise controlled by the positioning assembly 204. Other implementations can control movement of the support arms or rods 202 using a combination of linear and rotational movement. For instance, a 3-arm system can include two outer support arms 202 that can expand away from or retract towards a central support arm 202, and/or can be rotated about the central support arm 202. Other forms of movement or motion control can also be utilized.

The shape and geometry of the positioning assembly 204 can facilitate maneuvering and positioning of the product holding assembly 122 with respect to processing equipment and workstations 130 or secondary operation devices 140. The opening on the side of the open sided (U-shaped) structure can allow the product holding assembly 122 to pass over and/or around of the structure of, e.g., a workstation 130 for alignment of the supported garment or product for processing. For example, the open geometry in the support structure allows for the support arms or rods 202 to slide around material holders or guides of the workstation 130, allowing for transfer of the garment for processing. Without this feature, the support arms or rods 202 may need to be much longer so that the materials holders of the workstation 130 are able to exist between the held garment and the product holding assembly 122. In addition, the range of motion of the system may need additional flexibility to adjust to the material holders of the workstation 130.

The support arms or rods 202 can be contracted together using the positioning assembly 204 for insertion through an opening (or multiple openings) in, e.g., a garment or portion of a garment. Once inserted, the positioning assembly 204 can expand the support arms or rods 202 to engage with the inner surface of the material. The positioning of the support arms or rods 202 can be adjusted to tension the garment or portion of the garment to provide a reliable hold and/or to hold it in a specific shape. The shape or contour of the support arms or rods 202 can also be changed or modified to adjust the shape of the garment or portion of the garment for alignment with material holders or guides of the workstation 130 to ensure positive control for the processing operation. To improve or increase the surface contact with the material, the support arms or rods 202 can include contact control tips 216 at a distal end. The contact control tips 216 can be adjusted to assist with the insertion of the support arm or rod 202 through an opening in the garment or other product and then reconfigured to improve contact with the material for holding the garment or other product in position and/or to prevent the support arm or rod 202 from protruding from an opposite side of the garment or other product. The contact control tips 216 can be stationary or repositioned to facilitate insertion and/or engagement of the support arms or rods 202 into and/or with the garment. For instance, the garment can be stretched or damaged if the contact control tip 216 applies too much force against the material during insertion.

The contact control tips 216 can be spring loaded to control the amount of force being applied to the garment as it is being inserted. Undesirable engagement of the contact control tip 216 can be avoided by utilizing spring loading and/or controlling the shape of the distal end of the contact control tip 216. The shape of the contact control tips 216 can be designed to control or limit the force applied to the garment during insertion. In addition, the contact control tips 216 can include one or more sensors that can determine the amount of force being applied or the position with respect to the garment for proper engagement or positioning with respect to the processing equipment or workstation 130 for transfer of control of the garment for processing. The sensor(s) can be used to align the support arms or rods 202 with the workstation 130 for loading or unloading of the garment or to detect the garment on either the support arms or rods 202 or the workstation 130.

Figure 2B:
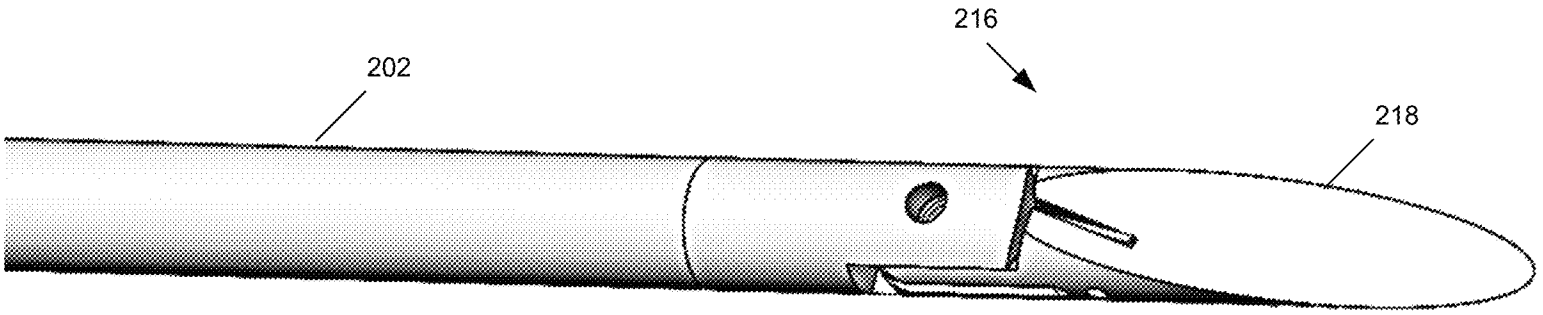

FIG. 2B shows an example of a contact control tip 216 at a distal end of a support arm or rod 202. The contact control tip 216 includes a structural extrusion 218 that is pivotally attached to the distal end of the support arm or rod 202. The structural extrusion 218 can be shaped, contoured, coated or textured to assist with the operation of the support arm or rod 202. In the example of FIG. 2B, the structural extrusion is tapered to a tip with a flat surface, which can assist in insertion of the support arm or rod 202 though an opening in the garment or other product. The contact control tip 216 can be pivoted about the pivot point using mechanical controls such as, e.g., one or more linkage, threaded rod, cable, pneumatic pistons, etc. that extend through the shaft of the support arm or rod 202 and engage with the structural extrusion 218. By pivoting the contact control tip 216, it is possible to improve or maximize the engagement with the inner surface of the material. The shape of the tip or a coating or texture of the surface of the structural extrusion 218 can also improve contact with the inner surface of the material. In addition, pivoting of the contact control tip 216 can ensure proper engagement with the garment and prevent the support arm or rod 202 from extending through the opposite side of the garment or other product. For instance, adjusting the shape or position of the contact control tip can avoid over extension of the support arms or rods 2020 through the garment by having a larger profile than an opening at the other end of the garment or other product. A sensor in the contract control tip 216 can also provide feedback with respect to the engagement and/or position with the garment. The contact control tip 216 can also pivot the structural extrusion 218 to aid with insertion of the support arm or rod 202 into the garment or other product.

In some implementations, the support arm or rod 202 can be rotated about its longitudinal axis to allow the contact control tips 216 to be pivoted in different directions. For example, the mounting blocks 210 can include pneumatically or electrically driven actuator(s) configured to rotate the support arms or rods 202, either individually or in combination, about their longitudinal axes. In other embodiments, the contact control tips 216 can be configured to rotate about the longitudinal axis. For instance, a portion of the structural extrusion surface may be textured while the remaining surface is smooth. The structural extrusion 218 can be positioned with the smooth surface adjacent to the material to assist with the insertion or removal of the support arms or rods 202 and rotated with the textured surface against the material to improve contact while the garment or other product is held in position.

Other types of contact control tips 216 can also be used. For example, the contact control tip 216 can include two or more folding surfaces or wings that can be rotated to fold together providing a uniform tip as the support arm or rod is inserted into the garment or other product and rotated outward away from each other to provide an expanded contact surface for engagement with the material. In other implementations, the contact control tip 216 can be segmented allowing for articulated motion similar to a finger or can comprise a hoop that can be extended or expanded to engage with the material or a bladder that can be inflated to increase engagement with the material. The contact control tip 216 can also include gripping devices that utilize, e.g., air flow, vacuum, mechanical gripping, such as a clamp, pinching, pins, or needles, electro-adhesion, adhesion, electrostatic forces, freezing, brush, or hook and loop to better hold the material on the support arms or rods 202. In some cases, the support arms or rods 202 can use these techniques to improve gripping along the length of the support arm or rod. For example, one or more suction holes can be located along the support arm or rod 202 to draw the material against the surface when a vacuum is applied. Orifices along the length of the support arm or rod 202 can direct air flow against the material to facilitate insertion or removal of the support arms or rods 202 into or from the garment or other product.

In other embodiments, the product holding assembly 122 can be configured to grip an outer surface of the garment or other product for loading, unloading or transport. For example, the support arms or rods 202 can be configured to grip the outer surface of the material. External handling devices can be included on or incorporated in the support arms or rods 202 to maintain a grip using, e.g., air flow, vacuum, or mechanical gripping, such as a clamp, pinching, pins, or needles, electro-adhesion, adhesion, electro-static forces, freezing, brush, hook and loop, etc. Once gripped, the garment or other product can be tensioned, positioned, oriented, or the shape of the garment or product can be adjusted or modified for loading onto or unloading from the equipment or workstation 130. For example, the support arms or rods 202 can be expanded away of each other to engage with an inner surface of the garment or other product to place it under tension. The support arms or rods 202 can then be repositioned (either individually or in combination) to change the shape of the garment or other product for loading onto or unloading from a workstation 130. For instance, the support arms or rods 202 may initially be positioned to tension the garment and hold it in a first shape (e.g., a rectangular shape having a width greater than its height). The shape of the garment may then be changed by repositioning one or more support arms or rods 202. For example, the support arms or rods 202 can be repositioned to change the shape of the garment (e.g., changing to a square or rectangular shape with a height greater than a width) that can make it easier to load or unload the garment over material holders or guides of the workstation. The support arms or rods 202 can be repositioned based upon the garment or other product and the workstation as needed.

The product holding assembly 122 can be coupled to a support assembly 124 such as, e.g., a carriage or other appropriate support device (e.g., an industrial robot). The product holding assembly 122 can be coupled to the support assembly 124 or other support device in a fixed orientation or can connected through a joint that allows for rotation or translation of the product holding assembly 122. For example, the product holding assembly 122 can be supported through a rotational joint or a horizontal and/or vertical translation joint attached to the cross-drive apparatus 208. In other implementations, the product holding assembly 122 can be coupled through a combination of a rotational joint and horizontal and vertical translation joints. Stacking of these joints in this order enables the product holding assembly 122 to be precisely positioned and oriented relative to the processing equipment or workstation 130. The support assembly 124 can comprise an XYZ cartesian motion system (e.g., cartesian coordinate robots, gantry robots or x-y-z robots) or articulated arms that can facilitate a wide range of motion for positioning the product holding assembly 122. For example, the product holding assembly 122 can be positioned by an industrial robot such as, e.g., 6-axis robots, articulated robots, selective compliance assembly robots (SCARA), or delta robots.

The support assembly 124 can be configured to transport the product holding assembly 122 between equipment or workstations 130 for processing of the garment or other product. For example, the support assembly 124 can comprise a carriage such as, e.g., an autonomous guide vehicle motorized for controlled movement between processing equipment or workstations 130 on wheels, tracks, rails, etc. In another example the support assembly 124 can comprise a linear or curved rail that supports one or more product holding assemblies 122 for transport between workstations 130. For example, one or more product holding assembly 122 can be coupled to a frame or carriage that can move along the rail. The product holding assembly 122 can be coupled to the frame or carriage via an XYZ cartesian motion system or articulated arms that can enable further positioning control of the product holding assembly 122 during loading and unloading of the garment with a workstation 130 or secondary operation device 140. The movement can be controlled automatically (e.g., by product holding module 118) or through user input. The support assembly 124 can also be repositioned manually by an operator or user. In this way, the material product holding system 120 can move between processing equipment or workstations 130 for fabrication of the garment or other product. The support assembly 124 can also utilize other transport or industrial conveying system configurations. For example, the product holding assembly 122 can be moved between equipment or workstations 130 using in industrial conveying system such as a conveyor belt, pallet conveyor, etc. In some embodiments, the product holding assembly 122 can be detachably attached to a support assembly 124 for processing by the equipment or workstation 130. The product holding assembly 122 (with the garment being held) may be detached (either autonomously or manually) from the support assembly 124 after processing is completed and placed on an industrial conveying system for transport to the next processing equipment or workstation 130, where it can be removed and attached (either autonomously or manually) to another support assembly 124 for further processing by that equipment or workstation 130.

Feedback for control of the material product holding system 120 can be provided by sensor device(s) 116, which can be distributed about the work area. Sensor feedback can be used to control the loading or unloading of the product on the product holding assembly 122, the loading or unloading of the product onto or from the processing equipment or workstation 130, or transport between the processing equipment or workstations 130. For example, laser height sensors can be used to determine the relative position of the product holding assembly 122 relative to the processing equipment or workstation 130. The sensor device(s) 116 can include, e.g., capacitive displacement sensors, eddy current sensors, Hall effect sensors, inductive sensors, laser doppler vibrometers, linear variable differential transformers, photodiode arrays, position encoders, potentiometer, optimal proximity sensors, ultrasonic sensors, or other types of monitoring sensors.

Functioning of the material product holding system 120 and the product holding module 118 of the robotic system 102 will now be explained with reference to FIG. 3. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 3:
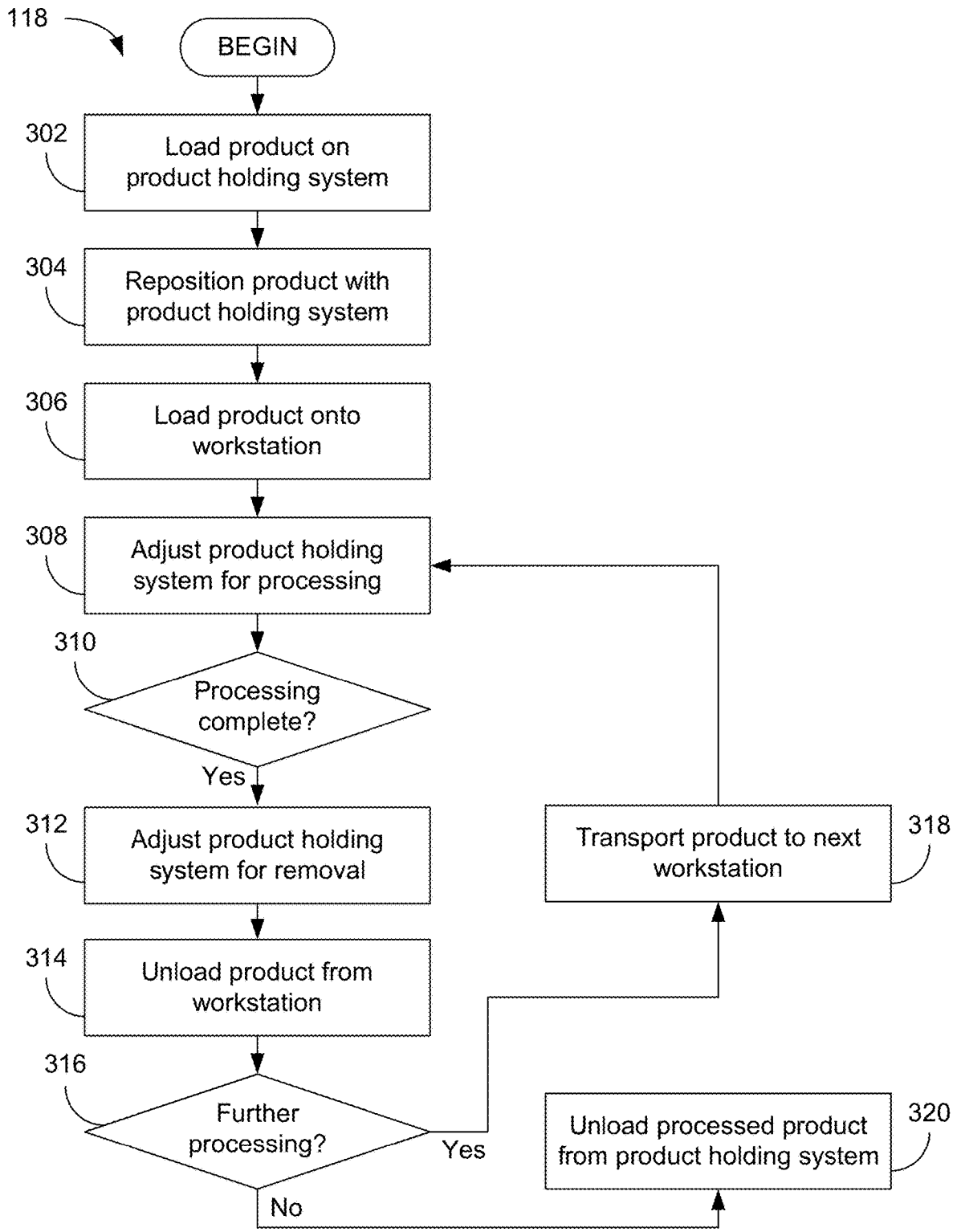
FIG. 3 illustrates an example of a product holding module, according to various embodiments of the present disclosure.

The flow chart of FIG. 3 shows the architecture, functionality, and operation of a possible implementation of the product holding module 118 (FIG. 1). The process begins at 302 where a product such as a garment (or a portion of a product or garment) is loaded on the material product holding system 120 (FIG. 2A). While the discussion with respect to FIG. 3 is in the context of a garment, the described operations are equally applicable to other products that are handled during processing by equipment or workstations 130. In addition to garments, products can include other manufactured items such as, but not limited to, pillowcases, covers, bags, etc. The installation of the garment or other product on the support arms or rods 202 can be accomplished manually by an operator or user, or can be automated using, e.g., an industrial robot with an end effector. The loading of the garment on the support arms or rods 202 can be automatically initiated or can be initiated through an HMI 108 by an operator or user. In some embodiments, the product holding assembly 122 can be positioned horizontally, vertically or in another appropriate orientation with the support arms or rods 202 retracted together to facilitate loading of the garment onto the support arms or rods 202.

In an automated system, the garment or product can be held in a state that allows the material product holding system 120 to take control of it. In some implementations, product manipulators 150 can assist in manipulating the garment or product to allow the material holding assembly 122 to take control. For example, a product manipulator 150 can grip and lift an edge of the opening of the garment, thereby separating an opening in the garment to allow insertion of the support arms or rods 202 into the garment. In other embodiments, air jets can direct airflow to allow separate the edges of the opening for insertion of support arms or rods. After the garment is positioned over the support arms or rods 202, the positioning assembly 204 can expand the support arms or rods 202 away from each other to engage with and tension the material for holding the product in position on the support arms or rods 202. The contact control tips 216 can then be operated to increase or maximize contact with the material.

At 304, garment can be repositioned by the material product holding system 120 to align the garment with a workstation or other processing equipment 130 (e.g., the joining device 132). For example, the material product holding system 120 can be rotated and/or translated by the support assembly 124, industrial robot, or other support device to align the support arms or rods 202 holding the garment with, e.g., a mandrel or other guide for the workstation 130. Sensing device(s) 116 or other sensor(s) can be used to align the support arms or rods 202 with the workstation 130 for loading of the garment at 306 or to detect the garment on either the support arms or rods 202 or the workstation 130. The garment orientation and tension can be adjusted by the material product holding system 120 to align with and provide clearance for loading over, e.g., a mandrel for a joining device 132. The material product holding system 120 can coordinate positioning of the garment for loading.

With the garment loaded on the workstation 130, the material product holding system 120 can be adjusted at 308 for processing of the garment. For example, the positioning assembly 204 can contract the support arms or rods 202 together and the support assembly 124 can reposition the product holding assembly 122 to remove them from inside the garment for processing by the workstation 130. The combination of the product holding assembly 122 and support assembly 124 can allow for fine adjustment of the garment with material holders or guides of the workstation 130 for transfer of the garment. Proper support, shaping and positioning of the garment by the product holding assembly 122 can ensure proper control of the garment during processing by the workstation 130. For example, the material holders of the workstation 130 can be repositioned (e.g., contracted) while support arms or rods 22 are expanded (either piecewise or continuously) to adjust the shape of the garment to pass over or around the material holders while maintaining a tensioned grip on the garment so that it does not slip, rotate, etc. In other implementations, the support arms or rods 202 and/or contact control tips 216 can be repositioned to remove the tension from the garment and allow it to rotate about the support arms or rods 202 during processing by the workstation 130. Processing of the garment can be monitored using sensors in the product holding assembly 122 and/or one or more sensor(s) 116 (e.g., cameras or other vision device(s)) located about the workstation 130.

When processing is complete at 310, the material product holding system 120 can be adjusted at 312 to remove the processed garment from the workstation 130. The product holding assembly 122 can be advanced and the support arms or rods 202 repositioned to align with the opening of the garment. The adjustment can ensure clearance between the support arms or rods 202 and the mandrel or guide of the workstation 130 before inserting the support arms or rods 202 into the garment opening. The contact control tips 216 can also be adjusted to facilitate insertion of the support arms or rods 202 into the garment. After insertion, the support arms or rods 202 can be expanded to contact and tension the material of the garment. The support arms or rods 202 can be expanded sufficiently to disengage the garment from the mandrel for unloading and the contact control tips 216 pivoted to ensure a secure grip. Sensing device(s) 116 or sensor(s) can be used to align the support arms or rods 202 with the workstation 130 for unloading of the garment or to detect the garment on either the support arms or rods 202 or the workstation 130. The support assembly 124 can then retract the product holding assembly 122 to unload the garment from the workstation 130 at 314.

If additional processing is scheduled for the unloaded garment at 316, then the material product holding system 120 can transport the garment to the next workstation or processing equipment 130 at 318. For example, the support assembly 124 can autonomously transport the garment on the product holding assembly 122 or an operator or user can manually move the material product holding system 120 to the next workstation 130. In some embodiments, an industrial robot can reposition the product holding assembly 122 between the workstations 130. The flow then returns to 308, where the material product holding system 120 can adjust the support arms or rods 202 for alignment of the garment with the next workstation 130 for processing. If there is no additional processing at 316, then the processed garment can be unloaded form the product holding assembly at 320. The contact control tips 216 can be pivoted to disengage from the material and the support arms or rods 202 contracted together to allow the garment to be removed. Unloading of the garment or other product from the support arms or rods 202 can be accomplished manually by an operator or user, or can be automated using, e.g., an industrial robot with an end effector. If another garment is to be processed, then the flow can resume at 302 by loading another garment.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A material product holding system, comprising:

a product holding assembly comprising:

a plurality of support arms, each of the plurality of support arms having a length extending from a proximal end to a distal end; and a positioning assembly coupled to each of the plurality of support arms, where each of the plurality of support arms are only supported by the positioning assembly at the proximal end, the positioning assembly configured to adjust positioning of the plurality of support arms with respect to each other to engage with at least a portion of a product supported by the plurality of support arms, where the positioning assembly is configured to adjust positioning of the plurality of support arms along a plurality of translational axes orthogonal to the length of each support arm; and a support assembly supporting the product holding assembly, the support assembly coupled to the positioning assembly.

2. The material product holding system of claim 1, wherein the plurality of support arms engage with an inner surface of the product.

3. The material product holding system of claim 2, wherein the plurality of support arms are repositioned with respect to each other thereby changing a shape of the product.

4. The material product holding system of claim 1, wherein the positioning assembly is configured to adjust positioning of the plurality of support arms along orthogonal translational axes.

5. The material product holding system of claim 4, wherein the positioning assembly comprises first and second arm drive apparatus coupled to a cross-drive apparatus, the first and second arm drive apparatus substantially perpendicular to the cross-drive apparatus thereby forming an open-sided structure having an open side opposite the cross-drive apparatus.

6. The material product holding system of claim 1, wherein each of the plurality of support arms comprise a contact control tip at the distal end of that support arm, the contact control tip configured to increase engagement with a surface of the product.

7. The material product holding system of claim 6, wherein the contact control tip comprises a structural extrusion pivotally mounted at the distal end of the support arm.

8. The material product holding system of claim 1, wherein the support assembly is configured to align the product holding assembly with a workstation for processing of the product.

9. The material product holding system of claim 8, wherein the workstation comprises a sewing machine.

10. The material product holding system of claim 1, wherein the product holding assembly is coupled to the support assembly via a horizontal or vertical translation joint.

11. The material product holding system of claim 1, wherein the product holding assembly is coupled to the support assembly via a rotational joint.

12. The material product holding system of claim 1, wherein the support assembly comprises a carriage supporting the product holding assembly and configured to position the product holding assembly.

13. The material product holding system of claim 12, wherein the support assembly is configured to autonomously transport the product holding assembly supporting the product between workstations.

14. The material product holding system of claim 1, wherein the support assembly comprises an industrial robot supporting the product holding assembly and configured to position the product holding assembly.

15. The material product holding system of claim 1, wherein the product is a garment or a portion of a garment.

16. The material product holding system of claim 1, wherein the support assembly comprises a carriage supporting the product holding assembly, the carriage configured to move between a first workstation and a second workstation, the carriage configured to position the product holding assembly with respect to the second workstation.

17. The material product holding system of claim 16, wherein the carriage is configured to autonomously transport the product holding assembly supporting the product to the second workstation.

18. The material product holding system of claim 16, wherein the carriage is an autonomous guide vehicle.

19. The material product holding system of claim 1, wherein the positioning assembly is configured to independently control each of the plurality of support arms.

20. A material product holding system, comprising:

a product holding assembly comprising:

a plurality of support arms; and a positioning assembly coupled to each of the plurality of support arms, the positioning assembly configured to adjust positioning of the plurality of support arms with respect to each other to engage with at least a portion of a product supported by the plurality of support arms, the positioning assembly configured to adjust positioning of the plurality of support arms along orthogonal translational axes, the positioning assembly comprising first and second arm drive apparatus coupled to a cross-drive apparatus, the first and second arm drive apparatus substantially perpendicular to the cross-drive apparatus thereby forming an open-sided structure having an open side opposite the cross-drive apparatus, wherein the first arm drive apparatus is configured to control positioning of at least a first support arm of the plurality of support arms parallel to a first orthogonal translational axis;

the second arm drive apparatus is configured to control positioning of at least a second support arm of the plurality of support arms parallel to the first orthogonal translational axis; and the cross-drive apparatus is configured to control positioning of the first and second support arms, and third and fourth support arms parallel to a second orthogonal translational axis; and a support assembly supporting the product holding assembly, the support assembly coupled to the positioning assembly.

* * * * *